US007963097B2

(12) United States Patent
Mastronarde

(10) Patent No.: US 7,963,097 B2
(45) Date of Patent: Jun. 21, 2011

(54) FLEXIBLE ASSEMBLY OF RECUPERATOR FOR COMBUSTION TURBINE EXHAUST

(75) Inventor: Thomas P. Mastronarde, West Hartford, CT (US)

(73) Assignee: Alstom Technology Ltd (CH)

( * ) Notice: Subject to any disclaimer, the term of this patent is extended or adjusted under 35 U.S.C. 154(b) by 765 days.

(21) Appl. No.: 11/970,197

(22) Filed: Jan. 7, 2008

(65) Prior Publication Data

US 2009/0173072 A1 Jul. 9, 2009

(51) Int. Cl.
*F02C 7/10* (2006.01)

(52) U.S. Cl. ..... 60/39.511; 60/682; 60/791

(58) Field of Classification Search ..... 60/727, 60/787, 791, 39.15, 39.511, 39.183, 650, 60/682–683

See application file for complete search history.

(56) References Cited

U.S. PATENT DOCUMENTS

| | | | | |
|---|---|---|---|---|
| 1,884,778 | A | 10/1932 | Lucke et al. | |
| 3,101,930 | A | 8/1963 | Huet | |
| 4,147,208 | A | 4/1979 | Naegelin | |
| 4,336,642 | A | 6/1982 | Engelberts | |
| 4,523,432 | A * | 6/1985 | Frutschi | 60/659 |
| 5,778,675 | A * | 7/1998 | Nakhamkin | 60/652 |
| 5,934,063 | A * | 8/1999 | Nakhamkin | 60/773 |
| 6,694,722 | B2 * | 2/2004 | Kreitmeier | 60/39.511 |
| 6,772,582 | B2 | 8/2004 | Reissig | |
| 6,848,259 | B2 | 2/2005 | Kelller-Sornig et al. | |
| 6,957,630 | B1 | 10/2005 | Mastronarde | |
| 2003/0051501 | A1 | 3/2003 | Matsushima et al. | |
| 2006/0130517 | A1 | 6/2006 | Merkys et al. | |

FOREIGN PATENT DOCUMENTS

| | | |
|---|---|---|
| WO | WO 92/22741 | 12/1992 |

OTHER PUBLICATIONS

PCT International Search Report and the Written Opinion of the International Searching Authority, dated Apr. 21, 2009—(PCT/US2009/030193).

* cited by examiner

*Primary Examiner* — Hoang M Nguyen
(74) *Attorney, Agent, or Firm* — Cantor Colburn LLP

(57) ABSTRACT

A recuperator includes a heating gas duct; an inlet manifold; a discharge manifold; and a once-through heating area disposed in the heating-gas duct through which a heating gas flow is conducted. The once-through heating area is formed from a plurality of first single-row header-and-tube assemblies and a plurality of second single-row header-and-tube assemblies. Each of the plurality of first single-row header-and-tube assemblies including a plurality of first heat exchanger generator tubes is connected in parallel for a through flow of a flow medium therethrough and further includes an inlet header connected to the inlet manifold. Each of the plurality of second single-row header-and-tube assemblies including a plurality of second heat exchanger generator tubes is connected in parallel for a through flow of the flow medium therethrough from respective first heat exchanger generator tubes, and further includes a discharge header connected to the discharge manifold. Each of the inlet headers is connected to the inlet manifold via a respective at least one of a plurality of first link pipes and each of the discharge headers is connected to the discharge manifold via a respective at least one of a plurality of second link pipes. Each of the heat exchanger tubes of each of the first and second single-row header-and-tube assemblies have an inside diameter that is less than an inside diameter of any of the plurality of first and second link pipes.

22 Claims, 7 Drawing Sheets

FLEXIBLE ASSEMBLY OF RECUPERATOR FOR COMBUSTION TURBINE EXHAUST

TECHNICAL FIELD

The present invention is related to recuperators, and more particularly to heating pressurized air in a recuperator capable of recovering exhaust energy from a utility scale combustion turbine.

BACKGROUND

The exchange of heat from a hot gas at atmospheric pressure to pressurized air may be performed in a recuperator, of which many conventional designs are available. These commercial designs are limited in size and have a poor service history when applied to large heat recovery applications, such as recovery of waste heat from the exhaust gas stream of a utility size combustion turbine. Waste heat from a combustion turbine may be used to heat compressed air stored for power generation purposes in compressed air energy storage (CAES) plants, or other process requiring heated compressed air.

CAES systems store energy by means of compressed air in a cavern during off-peak periods. Electrical energy is produced on-peak by admitting compressed air from the cavern to one or several turbines via a recuperator. The power train comprises at least one combustion chamber heating the compressed air to an appropriate temperature. To cover energy demands on-peak a CAES unit might be started several times per week. To meet load demands, fast start-up capability of the power train is mandatory in order to meet requirements of the power supply market. However, fast load ramps during start-up impose thermal stresses on the power train by thermal transients. This can have an impact on the lifetime of the power trains in that lifetime consumption increases with increasing thermal transients. For these types of applications, the physical size of the heat exchanger and the large transient thermal stresses associated with rapid heating of the recuperator during startup have proven to be beyond the capability of conventional recuperator equipment.

Common to all heat recovery air recuperators (HRARs), the temperature of the exhaust-gas stream declines from the exhaust-gas inlet to the exhaust-gas outlet of the heat exchanger. The amount of heat transferred in each heat exchanger tube row over which the exhaust-gas flows is proportional to the temperature difference between the exhaust-gas and the fluid in the heat exchanger tubes. Therefore, for each successive row of heat exchanger tubes in the direction of exhaust-gas flow, a smaller amount of heat is transferred, and the heat flux from the exhaust-gas to the fluid (e.g., compressed air) inside the tube declines with each tube row from the inlet to the outlet of the heat exchanger section. Therefore, for each successive row of heat exchanger tubes in the direction of gas flow, the temperature of the tube metal is determined by both the amount of heat flux across the tube wall and the average temperature of the fluid inside the tube.

For example, in a conventional recuperator, the temperature of the heat exchanger tube metal is determined by both the amount of heat flux across the heat exchanger tube wall and the average temperature of the flow medium inside the heat exchanger tube. Since the heat flux declines from the inlet to the outlet of the recuperator section, the temperature of the heat exchanger tube metal is different for each row of heat exchanger tubes included in the recuperator section.

Each manifold (header) of a horizontal heat recovery air recuperator (HRAR) that runs perpendicular to the exhaust-gas flow acts as a collection point for multiple rows of tubes.

These headers are of relatively large diameter and thickness to accommodate the multiple tube rows. FIGS. 1*a* and 1*b* are two views of such an assembly 100, known as a multi-row header-and-tube assembly, utilized in typical heat exchanger arrangements. Included in the assembly 100 is a header 101 and multiple tube rows 105A-105C. As shown in FIG. 1*a*, each individual tube row 105A-105C includes multiple tubes. In the interest of clarity of illustration, FIG. 1*b* only shows a single tube in each tube row 105A-105C. Since each of tube rows 105A-105C is at a different temperature, the mechanical force due to thermal expansion is different for each tube row 105A-105C. Such differential thermal expansion causes stress at tube bends and the attachment point of each individual tube to the header 101. Further, also contributing to thermal stresses at the attachment point of each individual tube to the header 101 is a difference in thickness between the relatively thin-wall tubes as compared to the thick-wall header 101. Under certain operating conditions, these stresses can cause failure of the attachment point, especially if the assembly 100 is subjected to many cycles of heating and cooling. Accordingly, a need exists for a flexible recuperator for large-scale utility plant applications that is capable of both rapid heating and cooling as well as a large number of start-stop cycles.

SUMMARY

According to the aspects illustrated herein, there is provided a recuperator including a heating gas duct; an inlet manifold; a discharge manifold; and a once-through heating area disposed in the heating-gas duct through which a heating gas flow is conducted. The once-through heating area is formed from a plurality of first single-row header-and-tube assemblies and a plurality of second single-row header-and-tube assemblies. Each of the plurality of first single-row header-and-tube assemblies including a plurality of first heat exchanger generator tubes is connected in parallel for a through flow of a flow medium therethrough and further includes an inlet header connected to the inlet manifold. Each of the plurality of second single-row header-and-tube assemblies including a plurality of second heat exchanger generator tubes is connected in parallel for a through flow of the flow medium therethrough from respective first heat exchanger generator tubes, and further includes a discharge header connected to the discharge manifold. Each of the inlet headers is connected to the inlet manifold via a respective at least one of a plurality of first link pipes and each of the discharge headers is connected to the discharge manifold via a respective at least one of a plurality of second link pipes. Each of the heat exchanger tubes of each of the first and second single-row header-and-tube assemblies have an inside diameter that is less than an inside diameter of any of the plurality of first and second link pipes.

According to the other aspects illustrated herein, there is provided a compressed air energy storage system. The compressed air energy storage system includes a cavern for storing compressed air; a power train comprising a rotor and one or several expansion turbines; and a system providing the power train with the compressed air from the cavern that includes a recuperator for preheating the compressed air prior to admission to the one or several expansion turbines and a first valve arrangement that controls the flow of preheated air from the recuperator to the power train. The recuperator includes: a heating gas duct which receives heating gas flow in an opposite direction to a flow of the compressed air; an inlet manifold; a discharge manifold; and a once-through heating area disposed in the heating-gas duct through which said heating gas flow is conducted. The once-through heating area is formed from a plurality of first single-row header-and-tube assemblies and a plurality of second single-row header-and-tube assemblies. Each of the plurality of first single-row header-and-tube assemblies including a plurality of first heat exchanger generator tubes is connected in parallel for a through flow of a flow medium therethrough and further includes an inlet header connected to the inlet manifold. Each of the plurality of second single-row header-and-tube assemblies including a plurality of second heat exchanger generator tubes is connected in parallel for a through flow of the flow medium therethrough from respective first heat exchanger generator tubes, and further includes a discharge header connected to the discharge manifold. Each of the inlet headers is connected to the inlet manifold via a respective at least one of a plurality of first link pipes and each of the discharge headers is connected to the discharge manifold via a respective at least one of a plurality of second link pipes. Each of the heat exchanger tubes of each of the first and second single-row header-and-tube assemblies have an inside diameter that is less than an inside diameter of any of the plurality of first and second link pipes.

According to the still other aspects illustrated herein, there is provided an apparatus for heating pressurized air capable of recovering exhaust energy from a utility scale combustion turbine. The apparatus includes: a heating gas duct; an inlet manifold; a discharge manifold; and a once-through heating area disposed in the heating-gas duct through which a heating gas flow is conducted. The once-through heating area is formed from a plurality of single-row header-and-tube assemblies. Each of the plurality of single-row header-and-tube assemblies includes a plurality of heat exchanger generator tubes connected in parallel for a through flow of a flow medium therethrough and further includes an inlet header connected to the inlet manifold. Each of the plurality of single-row header-and-tube assemblies is connected to the discharge manifold. Each of the inlet headers is connected to the inlet manifold via a respective at least one of a plurality of link pipes. Each of the heat exchanger tubes of the single-row header-and-tube assemblies have an inside diameter that is less than an inside diameter of any of the plurality of link pipes.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Figure 2:
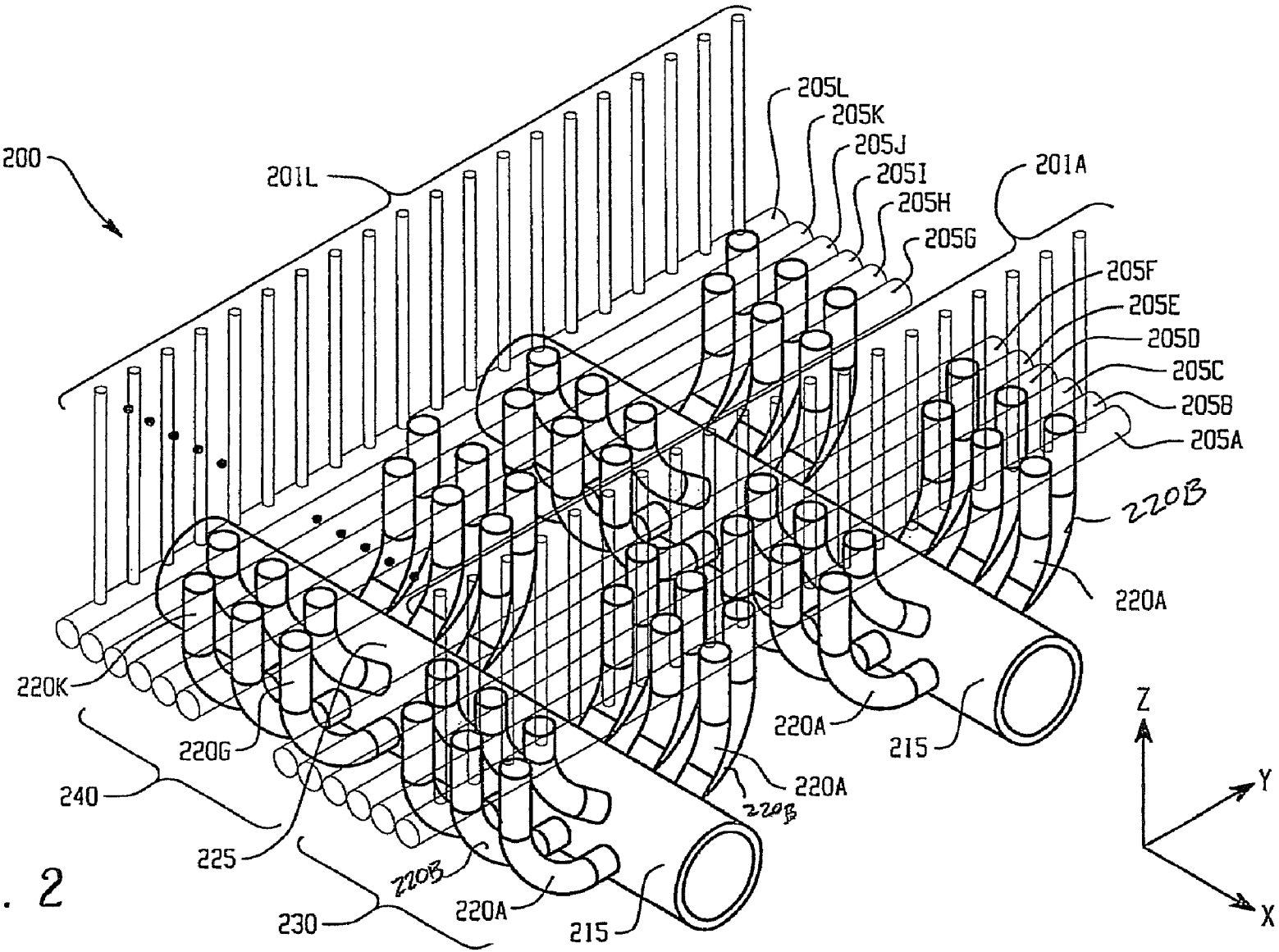
FIG. 2 is a front perspective view of a stepped component thickness with single row header-and-tube assembly for a heat recovery air recuperator (HRAR) in accordance with an exemplary embodiment of the present invention.
Figure 4:
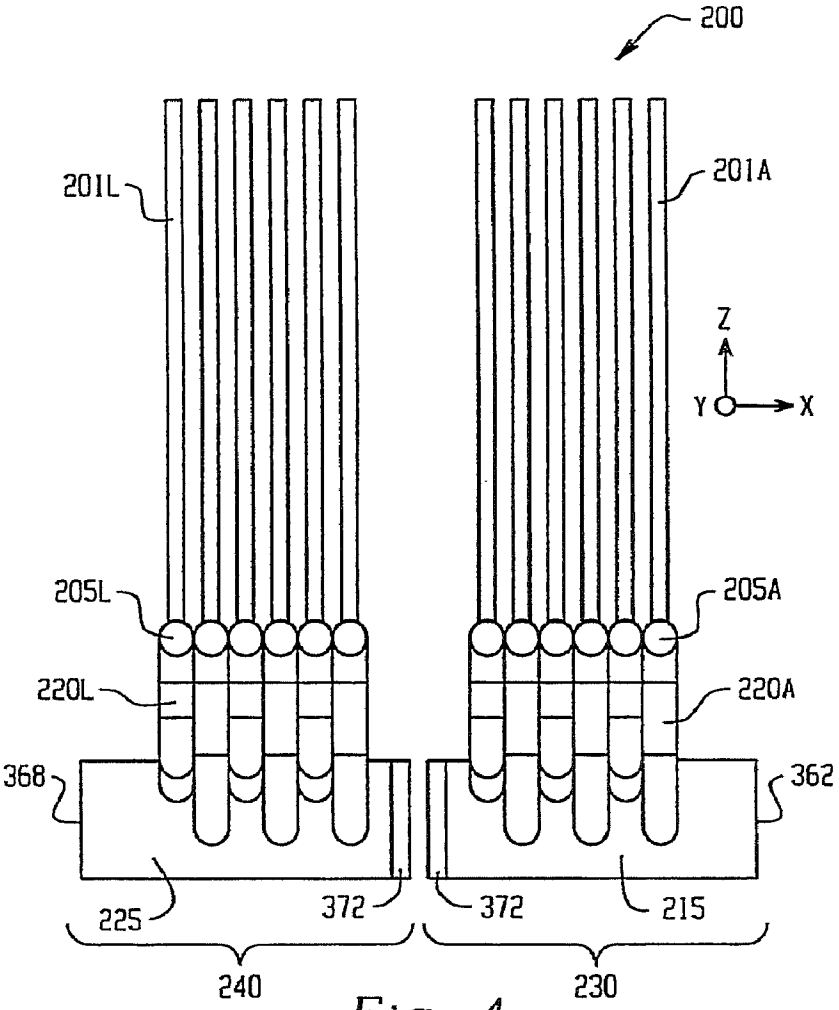
FIG. 4 is a side plan view of FIG. 2.
Figure 3:
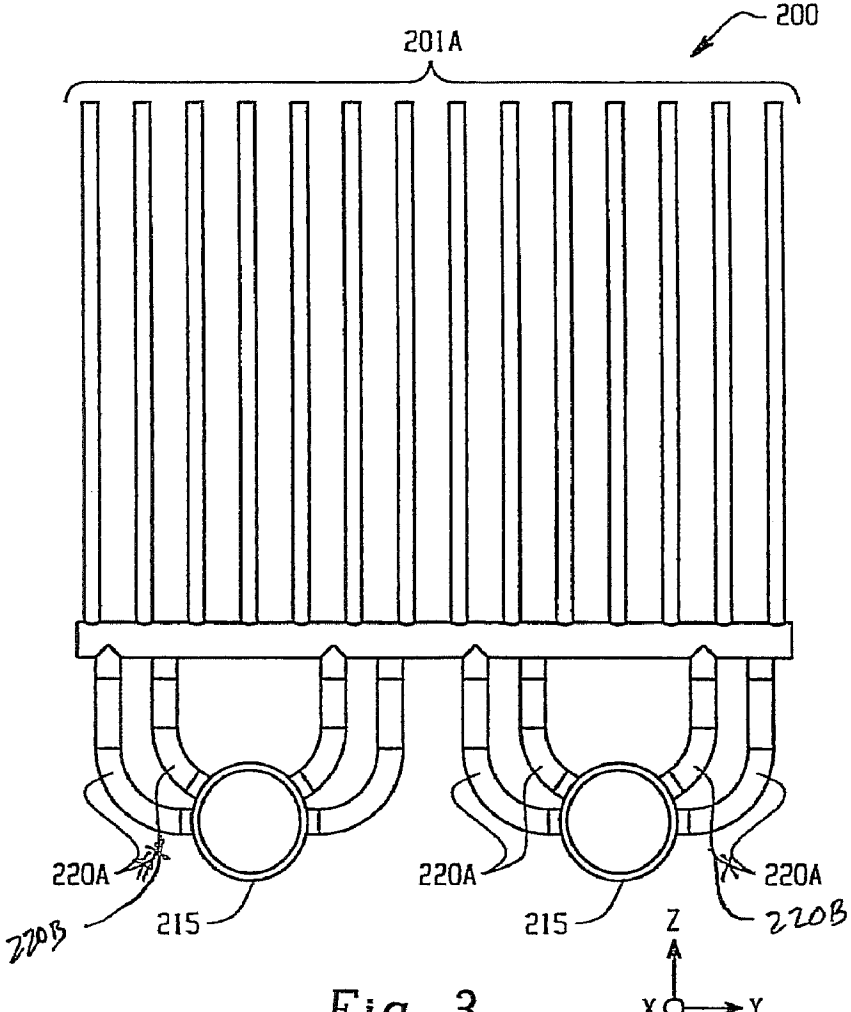
FIG. 3 is a front plan view of FIG. 2.

Referring to FIGS. 2-4, a stepped component thickness with single row header-and-tube assembly 200 that is not subject to bend and attachment failure due to thermal stresses, discussed above, is provided for use in a once-through type horizontal HRAR. FIGS. 3 and 4 are front and side views of the perspective view of the stepped component thickness with single row header-and-tube assembly 200 of FIG. 2. In the interest of clarity in the illustration, FIG. 2 only shows the outboard headers each having a single row of a plurality of tubes. However, the ellipsis illustrated in FIG. 2 indicates that each header includes a single row of tubes. More specifically, assembly 200 includes a first plurality of single tube rows 201A-201F (e.g., "first tube rows"), each first tube row attached to a first common header (or inlet header) 205A-205F, respectively. Thus, tube row 201A is attached to common header 205A, tube row 201B (not shown) is attached to common header 205B, and so on, through to tube row 201F being attached to common header 205F. Assembly 200 further includes a second plurality of single tube rows 201G-201L (e.g., "second tube rows"), each second tube row attached to a second common header (or discharge header) 205G-205L, respectively. Thus, tube row 201G (not shown) is attached to common header 205G, tube row 201H (not shown) is attached to common header 205H, and so on, through to tube row 201L being attached to common header 205H. Each common header 205A-205L extends in a y-axis direction and each first tube row 201A-201L extends in a z-axis direction, as illustrated. Such an arrangement as described above may be referred to as a stepped component single-row header-and-tube assembly discussed further hereinbelow.

Each header 205A-205F is connected to at least one first collection manifold (or inlet manifold) 215 (two shown) via at least one first link pipe 220A-220F (e.g., four first link pipes 220A shown). Thus, header 205A is connected to the collection manifold 215 via link pipe 220A, header 205B is connected to the collection manifold 215 via link pipe 220B, and so on, through header 205F being connected to the first collection manifold 215 via link pipe 220F. Each collection manifold 215 extends in an x-axis direction, as illustrated.

In this construction, a single row of tubes 201A-201F is attached to a relatively small diameter respective header 205A-205F with a thinner wall than the large header 215 illustrated in FIGS. 2-4. This arrangement may be described by the term "single-row header-and-tube assembly" for the tube-and-header assembly. The small headers 205A-205F are, in turn, connected to at least one large collection manifold 215, using pipes that may be described as links 220A-220F. The combination of tubes 201A-201F, small headers 205A-205F, links 220A-220F and large collection manifolds 215 may be described as a first stepped component thickness with single row header-and-tube assembly 230.

In like manner, each header 205G-205L is connected to at least one second collection manifold (or discharge manifold) 225 (two shown) via at least one second link pipe 220G-220L (e.g., four second link pipes 220G shown). Thus, header 205G is connected to the second collection manifold 225 via link pipe 220G, header 205H is connected to the second collection manifold 225 via link pipe 220H, and so on, through header 205L being connected to the second collection manifold 225 via link pipe 220L.

Each header 205G-205L is connected to at least one second collection manifold 225 via at least one second link pipe 220G-220L. Thus, header 205G is connected to the second collection manifold 225 via second link pipe 220G, and so on, through header 205L being connected to the second collection manifold 225 via second link pipe 220L. Likewise, the arrangement with respect to the second headers 205G-205L and associated tubes 201G-201L is referred to a second single-row-and-tube assembly. As described above with respect to the first stepped component thickness single-row header-and-tube assembly 230, such an arrangement may be referred to as a second stepped component thickness single-row header-and-tube assembly 240.

Each tube of each tube row 201A-201L has a smaller diameter than each common header 205A-205L and each link pipe 220A-220L. Each common header 205A-205L has a smaller diameter and thinner wall thickness than each collection manifold 215.

Figure 1B:
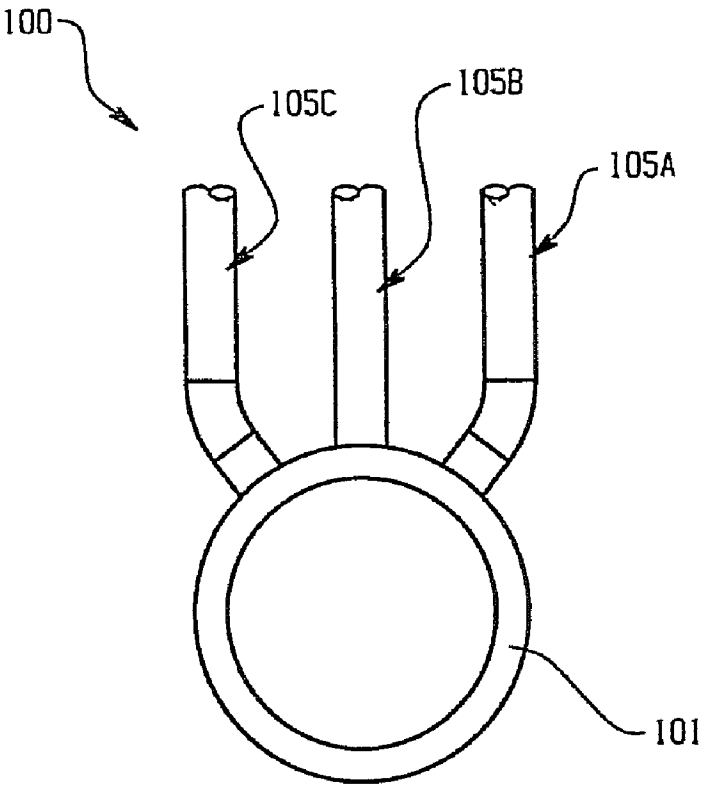
Fig. 1b PRIOR ART
FIG. 1*b* is a front plan view of the multi-row header-and-tube assembly shown in FIG. 1*a;*
Figure 1A:
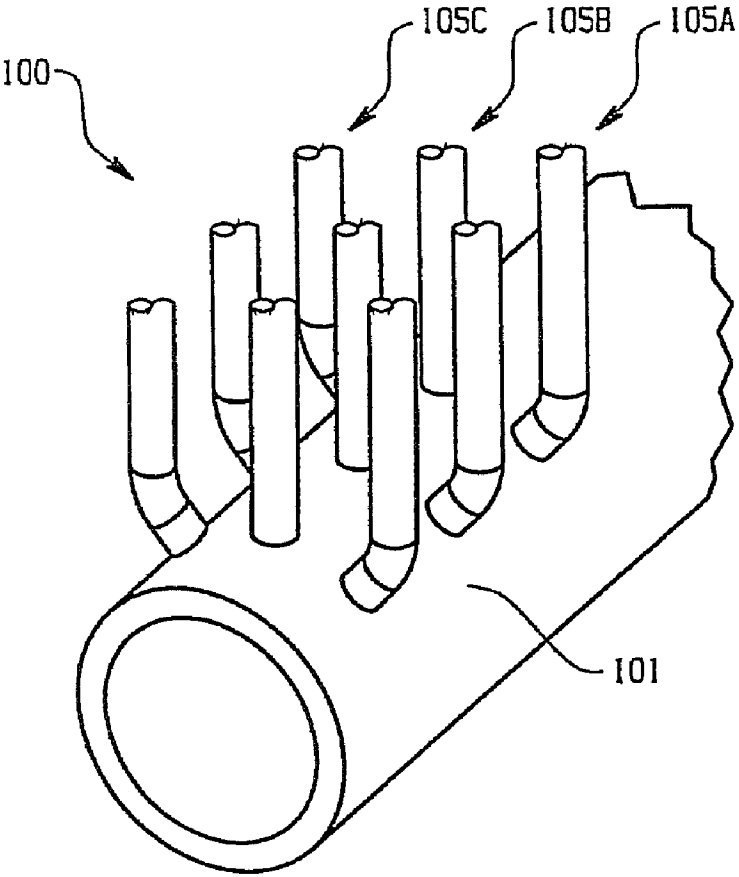
Fig. 1a PRIOR ART
FIG. 1*a* is a perspective view of a multi-row header-and-tube assembly utilized in prior art heat recovery air recuperator.

As a result of this configuration, a high concentration of stresses during heating and cooling does not occur at bends and attachment points. More particularly, because the tubes of each tube row 201A-201L do not have bends, no thermal stress associated with bends exists. Also, bending stress at the weld attachment of each tube to each header 205A-205L does not occur because a bending moment imposed by tube bends during heating does not exist. Thus, the single-row assemblies 230 and 240 can withstand many more cycles of heating and cooling than the multi-row header-and-tube assembly 100 depicted in FIG. 1, and discussed above.

Figure 5:
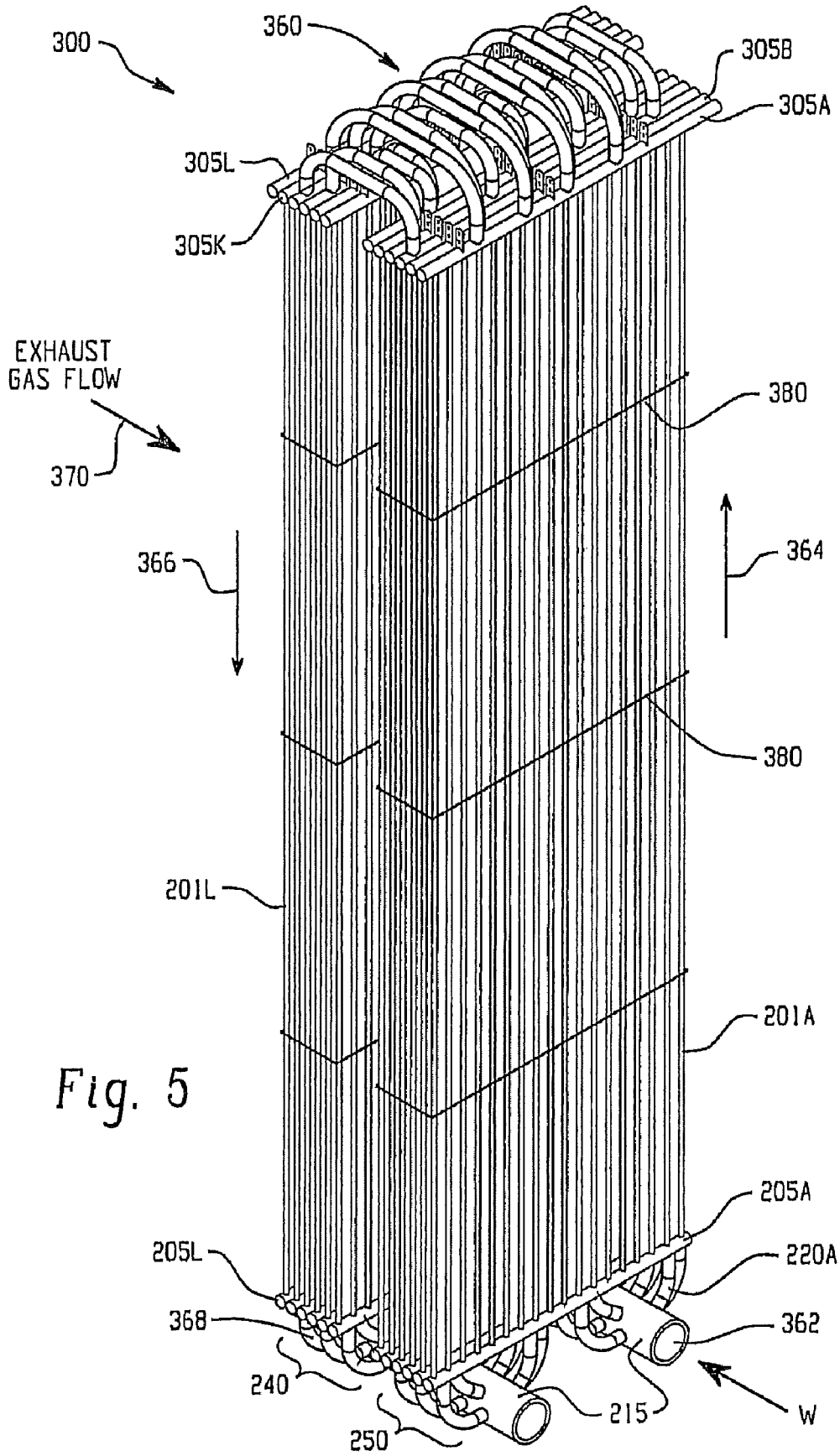
FIG. 5 is front perspective view of a HRAR module in accordance with an exemplary embodiment of the present invention.

FIG. 5 is front perspective view of a HRAR module (once-through heating area) 300 including the first stepped component thickness single-row header-and-tube assembly 230 and second single-row header-and-tube assembly 240 of FIGS. 2-4 in accordance with an exemplary embodiment of the present invention. The HRAR module 300 illustrates fluid communication of the first stepped component thickness single-row header-and-tube assembly 230 with the second single-row header-and-tube assembly 240 via a top portion 360 of module 300.

Figure 6:
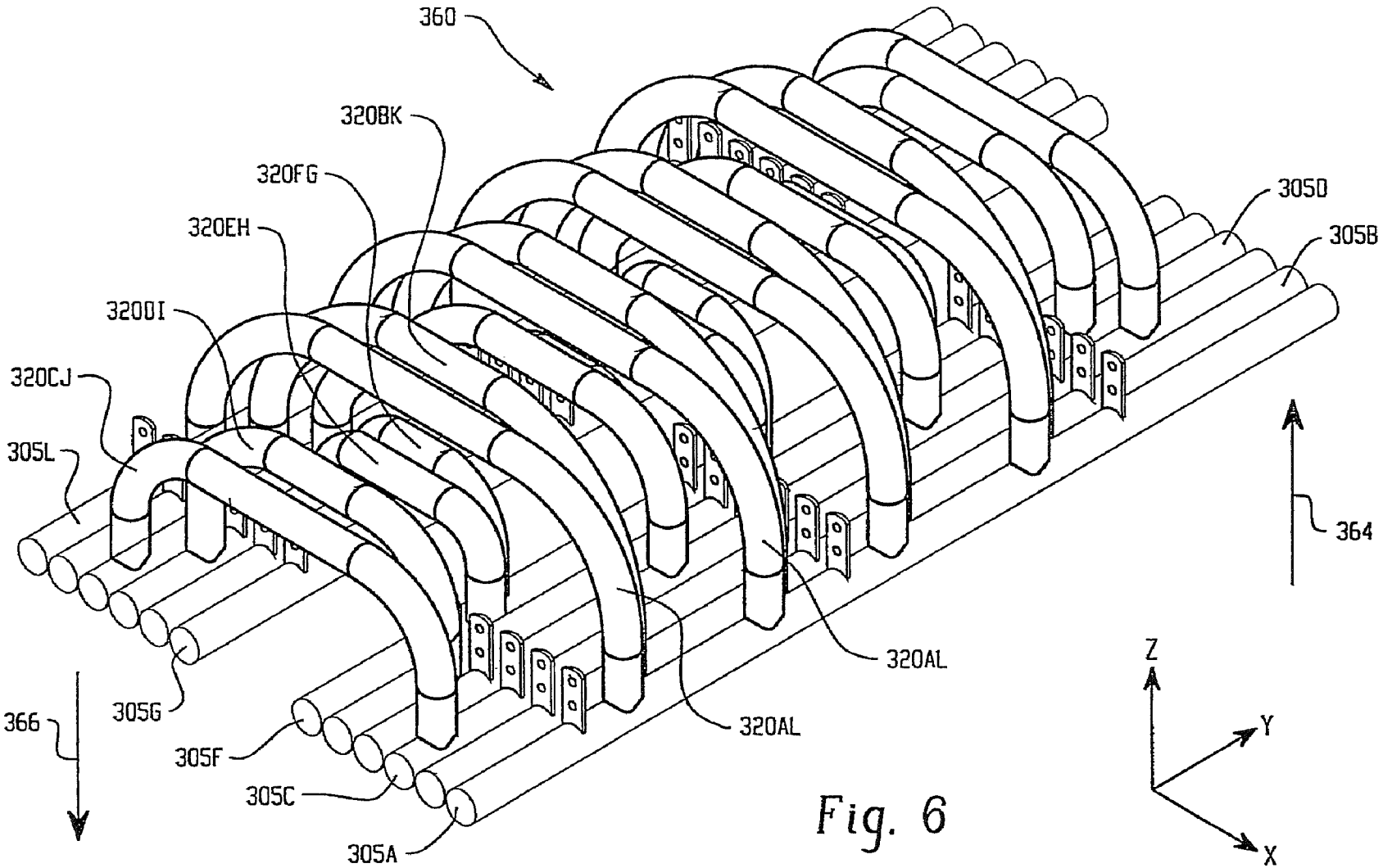
FIG. 6 is an enlarged perspective view of a top portion of the module of FIG. 5.

Referring to FIG. 6, the top portion 360 includes a plurality of third common headers 305A-305L connected to a corresponding tube row 201A-201L, and hence in fluid communication with a respective common header 205A-205L via a corresponding tube row 201A-201L. Furthermore, third common headers 305A-305F are in fluid communication with corresponding third common headers 305G-305L via a corresponding third link pipe 320AL, 320BK, 320CJ, 320DI, 320EH and 320FG, respectively.

For example and referring again to FIG. 5, a fluid medium W (e.g., compressed air) flows into first common header 205 from an inlet 362 of first manifold 215 via first link pipe 220A and flows through the first tube row 201A in a first direction indicated by arrow 364 in FIGS. 5 and 6. Fluid medium W then flows into corresponding third header 305A and then into third header 305L via third link pipe 320AL. Fluid medium W then flows into corresponding second tube row 201L in a second direction indicated by arrow 366 in FIGS. 5 and 6. Second common header 205L receives fluid medium W from corresponding second tube row 201L and outputs fluid medium W from an outlet 368 of second manifold 225 via connection with second link 220L. The HRAR module 300 is shown with the outlet 368 facing an exhaust gas flow 370 from a combustion turbine, for example, but is not limited thereto, and the inlet 362 downstream of the exhaust gas flow 370. Referring to FIG. 4, it will be recognized that the manifolds 215 and 225 each have a cap 372 on an opposite end thereof relative to inlet 362 and outlet 368, respectively.

Figure 7:
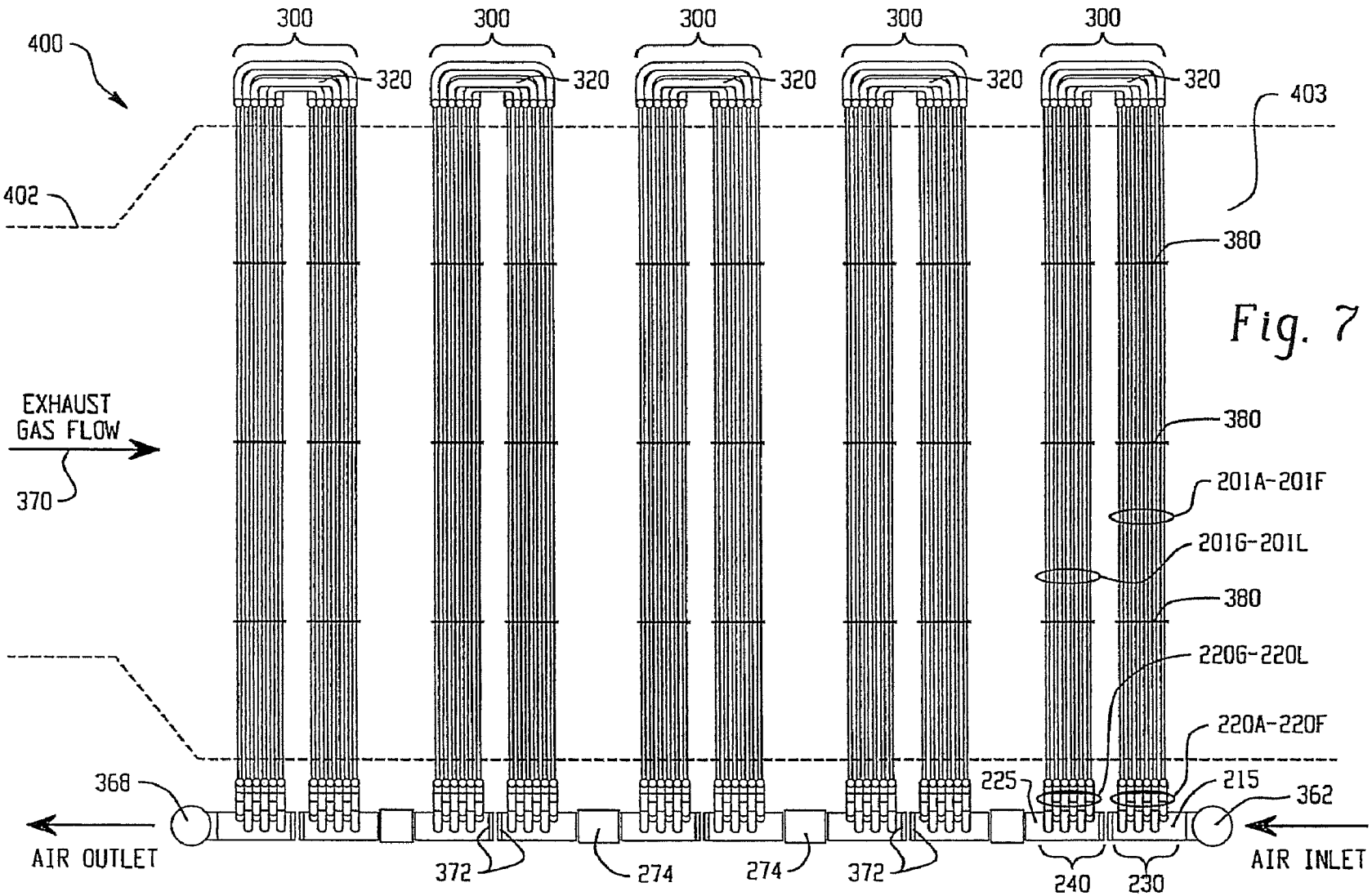
FIG. 7 is a side elevation view of an exemplary recuperator assembly having five HRAR modules of FIG. 5 assembled together and disposed in a heat gas duct in accordance with an exemplary embodiment of the present invention.

Referring now to FIG. 7, there is shown one embodiment of a once-through type horizontal heat recovery air recuperator (HRAR) of the present invention incorporating fifteen (15) HRAR modules 300 (e.g., triple wide modules 300 in five sections, but not limited thereto), hereinafter generally designated as recuperator 400. It can be seen that the recuperator 400 is disposed downstream of a gas turbine (not shown) on the exhaust-gas side thereof. The recuperator 400 has an enclosing wall 402 which forms a heating-gas duct 403 through which flow can occur in an approximately horizontal heating-gas direction indicated by the arrow 370 and which is intended to receive the exhaust-gas from the gas turbine. HRAR modules 300 are serially connected to each other and positioned in the heating-gas duct 403. In the exemplary embodiment of FIG. 7, five modules 300 are shown serially connected together, but one module 300, or a larger number of modules 300 may also be provided without departing from the essence of the present invention.

The modules 300, common to the respective embodiment illustrated in FIGS. 2 through 5, contain a number of first tube rows 201A-201F and second tube rows 201G-201L, respectively, which are disposed one behind the other in the heating-gas direction. Each tube row of first tube rows 201A-201F in turn is connected to a respective tube row of second tube rows 201G-201L via a corresponding link 320 as described above with respect to FIGS. 5 and 6 and are disposed next to one another in the heating-gas direction. In FIG. 7, only a single vertical heat exchanger tube 201 can be seen in each tube row 201A-201L.

Heat exchanger tubes 201 of a respective common tube row 201A-201F of the first tube row for each module 300 are each connected in parallel to a respective common first inlet header 205A-205F, forming a first single-row header-and-tube inlet assembly, discussed above and shown in FIGS. 2 through 5. Also, the heat exchanger tubes 201 of the first common tube rows 201A-201F of each module 300 are each connected to a respective third common discharge header 305A-305F, thus forming a single-row header-and-tube inlet assembly for each row 201A-201F. Likewise, heat exchanger tubes 201 of second common tube rows 201G-201L of a second once-through heating area are each connected in parallel to a respective common inlet third header 305G-305L, forming a single-row header-and-tube discharge assembly for each row 201G-201L, and are also each connected in parallel to a respective common discharge second header 205G-205L, thus forming a second single-row header-and-tube discharge assembly for each row 201G-201L. Each respective third common discharge header 305A-305F is connected to a respective common inlet header 305G-305L via a respective link pipe 320.

Each first single-row header-and-tube inlet assembly of each module 300 is connected to an inlet manifold 215 via a first link pipe 220A-220F, thus forming a first stepped component thickness with the single row header-and-tube inlet assembly 230. Also, each second single-row header-and-tube discharge assembly of each module 300 is connected to a discharge manifold 225 via a second link pipe 220G-220L, thus forming a second stepped component thickness with the single row header-and-tube discharge assembly 240.

Each outlet 368 of a second manifold 225 of one module 300 is connected to an inlet 362 of a first manifold 215 of a successive module 300 via a coupler 374, but for the first and last modules 300 connected in series. Flow medium W enters the first stepped component thickness with the single row header-and-tube inlet assembly 230 of a first module 300, flows in parallel though the tube rows 201A-201F, and exits the first stepped component thickness with the single row header-and-tube inlet assembly 230 of the first module through third link pipe 320A-320L into the second stepped component thickness with the single row header-and-tube discharge assembly 240 of the first module 300 and exits via the discharge manifold 225. Flow medium W then travels into an inlet 362 of a second module 300 connected to the outlet 368 of the first module 300. The inlet 362 and outlet 368 are connected with coupler 374.

A significant improvement in the flexibility of large recuperators can be achieved with an assembly of heat exchanger sections or modules 300 constructed using the configuration described above in FIG. 7 as a "stepped component thickness with single row header-and-tube assembly". This new assembly uses single-row header-and-tube-assemblies throughout the recuperator to form the fluid circuits arranged in counter-flow required for a large recuperator 400, as illustrated in FIG. 7.

The large recuperator described with respect to FIG. 7 accommodates partial air flow during startup to minimize venting of stored air. The heat exchanger modules are completely drainable and ventable. Vents (not shown) may provided at every high point (e.g., using threaded plugs) for future maintenance purposes. Lower manifolds 215, 225 may be fitted with drain piping and drain valves terminating outside the casing or heat gas duct 403.

The heat exchanger modules 300 are completely shop-assembled with finned tubes, headers, roof casing, and top support beams. Heat exchanger modules 300 are installed from the top into the steel structure. Tube vibration is controlled by a system of tube restraints 380, as best seen with reference to FIG. 5, proven in large heat recovery steam generator (HRSG) service. Using the combination of these two concepts will allow the production of flexible recuperators for large-scale applications capable of rapid heating and cooling and a large number of start-stop cycles. For example, FIG. 8 is a schematic view illustrating the recuperator assembly of FIG. 7 employed in a compressed air energy storage (CAES) system having a capacity of around 150-300 MW.

Figure 8:
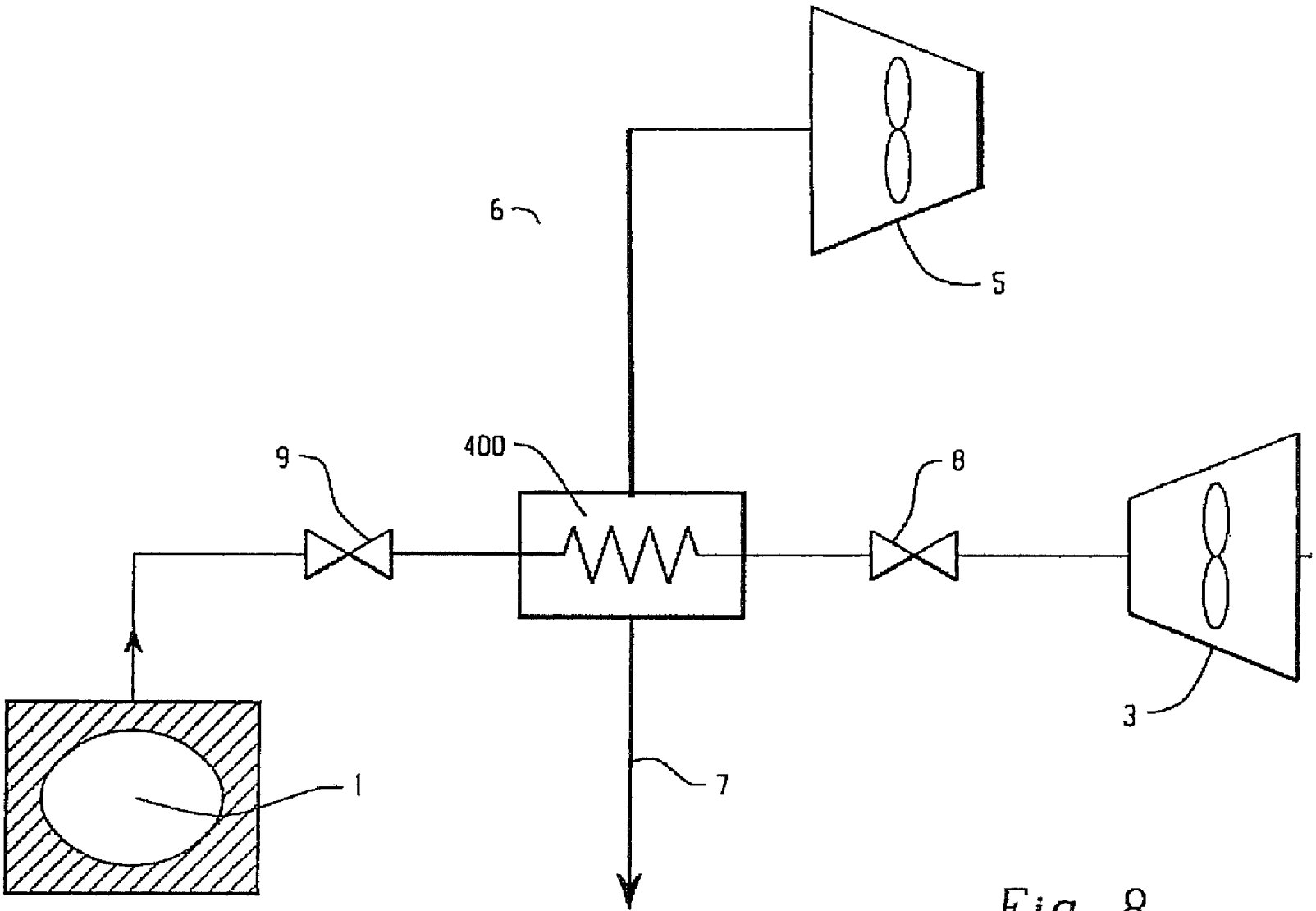
FIG. 8 is a schematic view illustrating the recuperator assembly of FIG. 7 employed in a compressed air energy storage (CAES) system.

A basic layout of a CAES power plant is shown in FIG. 8. The plant comprises a cavern 1 for storing compressed air. The recuperator 400 as described with reference to FIG. 7 preheats the compressed air from the cavern 1 before it is admitted to an air turbine 3. The recuperator 400 preheats the compressed air from cavern 1 via an exhaust gas flow flowing in an opposite direction, such as from a gas turbine 5, for example. Following heat transfer to the cold compressed air from the cavern 1, the flue gas leaves the system through the stack 7. The airflow to the recuperator 400 and to the air turbine 3 is controlled by valve arrangements 8 and 9, respectively.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A recuperator comprising:

a heating gas duct;

an inlet manifold;

a discharge manifold; and a once-through heating area disposed in the heating-gas duct through which a heating gas flow is conducted, said once-through heating area being formed from a plurality of first single-row header-and-tube assemblies and a plurality of second single-row header-and-tube assemblies, each of said plurality of first single-row header-and-tube assemblies including a plurality of first heat exchanger generator tubes connected in parallel for a through flow of a flow medium therethrough and further including an inlet header connected to said inlet manifold, said each of said plurality of second single-row header-and-tube assemblies including a plurality of second heat exchanger generator tubes connected in parallel for a through flow of said flow medium therethrough from respective said first heat exchanger generator tubes, and further including a discharge header connected to said discharge manifold, each of said inlet headers being connected to said inlet manifold via a respective at least one of a plurality of first link pipes, each of said discharge headers being connected to said discharge manifold via a respective at least one of a plurality of second link pipes, and each of said heat exchanger tubes of each of said first and second single-row header-and-tube assemblies having an inside diameter that is less than an inside diameter of any of said plurality of first link pipes and of any of said plurality of second link pipes.

2. The recuperator of claim 1, wherein the heating gas flow is conducted in an approximately horizontal heating-gas direction.

3. The recuperator of claim 1, wherein said flow medium is compressed air.

4. The recuperator of claim 1, wherein at least one of said plurality of second heat exchanger tubes associated with said plurality of second single-row header-and-tube assemblies is heated to a greater extent than said plurality of first heat exchanger tubes associated said plurality of first single-row header-and-tube assemblies.

5. The recuperator of claim 1, wherein said inlet manifold has an inside diameter greater than an inside diameter of each of said inlet headers; and said discharge manifold has an inside diameter greater than an inside diameter of each of said discharge headers.

6. The recuperator of claim 1, wherein said once-through heating area is a first once-through heating area, said inlet manifold is a first inlet manifold, said discharge manifold is a first discharge manifold, and further comprising: a second once-through heating area disposed in said heating-gas duct, said second once-through heating area being formed from another plurality of first and second single-row header-and-tube assemblies, each of said another plurality of first and second single-row header-and-tube assemblies including a plurality of first and second heat exchanger tubes, respectively, connected in parallel for a through flow of the flow medium therethrough, each of said another plurality of first single-row header-and-tube assemblies including an inlet header connected to a second inlet manifold and each of said another plurality of second single-row header-and-tube assemblies including a discharge header connected to a second discharge manifold, wherein said first once-through heating area is in fluid communication with second once-through heating area by connecting the first discharge manifold to the second inlet manifold.

7. The recuperator of claim 6, wherein said second once-through heating area is heated to a greater extent than said first once-through heating area.

8. The recuperator of claim 1, wherein each of said plurality of second heat exchanger tubes associated with said plurality of second single-row header-and-tube assemblies is in fluid communication with a respective said first heat exchanger tube of said plurality of first heat exchanger tubes associated said plurality of first single-row header-and-tube assemblies via a top portion of the once-through heating area.

9. The recuperator of claim 1, wherein the top portion of the once-through heating area includes a plurality of first and second common headers connected to a corresponding tube row of said first and second heat exchanger generator tubes, respectively, a first common header of said plurality of first common headers is in fluid communication with a corresponding second common header of said plurality of second common headers via a corresponding third link pipe.

10. The recuperator of claim 1, wherein said recuperator is a heat recovery air recuperator.

11. A compressed air energy storage system, comprising:

a cavern for storing compressed air;

a power train comprising a rotor and one or several expansion turbines; and a system providing said power train with said compressed air from said cavern that includes a recuperator for preheating said compressed air prior to admission to said one or several expansion turbines and a first valve arrangement that controls the flow of preheated air from said recuperator to said power train, wherein said recuperator includes:

a heating gas duct through which a heating gas flow is conducted in an opposite direction to a flow of the compressed air;

an inlet manifold;

a discharge manifold; and a once-through heating area disposed in the heating-gas duct through which said heating gas flow is conducted, said once-through heating area being formed from a plurality of first single-row header-and-tube assemblies and a plurality of second single-row header-and-tube assemblies, each of said plurality of first single-row header-and-tube assemblies including a plurality of first heat exchanger generator tubes connected in parallel for a through flow of a flow medium therethrough and further including an inlet header connected to said inlet manifold, said each of said plurality of second single-row header-and-tube assemblies including a plurality of second heat exchanger generator tubes connected in parallel for a through flow of said flow medium therethrough from respective said first heat exchanger generator tubes, and further including a discharge header connected to said discharge manifold, each of said inlet headers being connected to said inlet manifold via a respective at least one of a plurality of first link pipes, each of said discharge headers being connected to said discharge manifold via a respective at least one of a plurality of second link pipes, and each of said heat exchanger tubes of each of said first and second single-row header-and-tube assemblies having an inside diameter that is less than an inside diameter of any of said plurality of first link pipes and of any of said plurality of second link pipes.

12. The compressed air energy storage system of claim 11, wherein the heating gas flow is conducted in an approximately horizontal heating-gas direction.

13. The compressed air energy storage system of claim 11, wherein said flow medium is compressed air.

14. The compressed air energy storage system of claim 11, wherein at least one of said plurality of second heat exchanger tubes associated with said plurality of second single-row header-and-tube assemblies is heated to a greater extent than said plurality of first heat exchanger tubes associated said plurality of first single-row header-and-tube assemblies.

15. The compressed air energy storage system of claim 11, wherein said inlet manifold has an inside diameter greater than an inside diameter of each of said inlet headers; and said discharge manifold has an inside diameter greater than an inside diameter of each of said discharge headers.

16. The compressed air energy storage system of claim 11, wherein said once-through heating area is a first once-through heating area, said inlet manifold is a first inlet manifold, said discharge manifold is a first discharge manifold, and further comprising: a second once-through heating area disposed in said heating-gas duct, said second once-through heating area being formed from another plurality of first and second single-row header-and-tube assemblies, each of said another plurality of first and second single-row header-and-tube assemblies including a plurality of first and second heat exchanger tubes, respectively, connected in parallel for a through flow of the flow medium therethrough, each of said another plurality of first single-row header-and-tube assemblies including an inlet header connected to a second inlet manifold and each of said another plurality of second single-row header-and-tube assemblies including a discharge header connected to a second discharge manifold, wherein said first once-through heating area is in fluid communication with second once-through heating area by connecting the first discharge manifold to the second inlet manifold.

17. The compressed air energy storage system of claim 16, wherein said second once-through heating area is heated to a greater extent than said first once-through heating area.

18. The compressed air energy storage system of claim 11, wherein each of said plurality of second heat exchanger tubes associated with said plurality of second single-row header-and-tube assemblies is in fluid communication with a respective said first heat exchanger tube of said plurality of first heat exchanger tubes associated said plurality of first single-row header-and-tube assemblies via a top portion of the once-through heating area.

19. The compressed air energy storage system of claim 1, wherein the top portion of the once-through heating area includes a plurality of first and second common headers connected to a corresponding tube row of said first and second heat exchanger generator tubes, respectively, a first common header of the plurality of common headers is in fluid communication with a corresponding second common header of the plurality of second common headers via a corresponding third link pipe.

20. The compressed air energy storage system of claim 1, wherein said recuperator is a heat recovery air recuperator.

21. An apparatus for heating pressurized air capable of recovering exhaust energy from a utility scale combustion turbine, the apparatus comprising:

a heating gas duct;

an inlet manifold;

a discharge manifold; and a once-through heating area disposed in the heating-gas duct through which a heating gas flow is conducted, said once-through heating area being formed from a plurality of single-row header-and-tube assemblies, each of said plurality of single-row header-and-tube assemblies including a plurality of heat exchanger generator tubes connected in parallel for a through flow of a flow medium therethrough and further including an inlet header connected to said inlet manifold, said each of said plurality of single-row header-and-tube assemblies connected to said discharge manifold, each of said inlet headers being connected to said inlet manifold via a respective at least one of a plurality of link pipes, and each of said heat exchanger tubes of said single-row header-and-tube assemblies having an inside diameter that is less than an inside diameter of any of said plurality of link pipes.

22. The apparatus of claim 21, wherein the heating gas duct; the inlet manifold; the discharge manifold; and the once-through heating area define a recuperator.

* * * * *

UNITED STATES PATENT AND TRADEMARK OFFICE

CERTIFICATE OF CORRECTION

PATENT NO. : 7,963,097 B2
APPLICATION NO. : 11/970197
DATED : June 21, 2011
INVENTOR(S) : Thomas P. Mastronarde It is certified that error appears in the above-identified patent and that said Letters Patent is hereby corrected as shown below:

In column 6, line 47-48, delete "201 L" and insert -- 201L --, therefor.

Signed and Sealed this
First Day of January, 2013

David J. Kappos

David J. Kappos
*Director of the United States Patent and Trademark Office*